United States Patent [19]

Krafft et al.

[11] 4,088,493

[45] May 9, 1978

[54] DIFFUSION RETARDING LAYERS COMPRISING POLYMERS OF DIMETHOXYETHYLENE

[75] Inventors: Werner Krafft, Leverkusen; Gunther Matschke, Opladen; Erich Wolff, Leverkusen, all of Germany

[73] Assignee: Agfa-Gevaert Aktiengesellschaft, Leverkusen, Germany

[21] Appl. No.: 633,801

[22] Filed: Nov. 20, 1975

[30] Foreign Application Priority Data

Nov. 26, 1974 Germany ..... 2455762

[51] Int. Cl.[2] ..... G03C 1/40; G03C 7/00; G03C 5/54

[52] U.S. Cl. ..... 96/77; 96/3; 96/29 D

[58] Field of Search ..... 96/77, 29 D, 3, 74, 96/73, 72, 68, 69

[56] References Cited

U.S. PATENT DOCUMENTS

| | | | |
|---|---|---|---|
| 3,419,389 | 12/1968 | Haas et al. | 96/77 |
| 3,421,893 | 1/1969 | Taylor | 96/77 |
| 3,433,633 | 3/1969 | Haas | 96/77 |
| 3,455,686 | 7/1969 | Farney et al. | 96/77 |
| 3,575,700 | 4/1971 | Taylor | 96/77 |
| 3,615,422 | 10/1971 | Hablerin | 96/77 |
| 3,785,815 | 1/1974 | Avtges et al. | 96/77 |
| 3,847,615 | 11/1974 | Yoshida et al. | 96/77 |

*Primary Examiner*—Edward C. Kimlin
*Assistant Examiner*—Richard L. Schilling
*Attorney, Agent, or Firm*—Connolly and Hutz

[57] ABSTRACT

A neutralization system for the dye diffusion transfer process comprises an acid polymer layer containing a polymer with free acid groups and a retarding layer. The retarding layer contains a hydratable polymer which in its non-hydrated state is a barrier for hydroxyl ions and in its hydrated state provides no resistance for diffusing hydroxyl ions. The retarding layer is arranged between a laminate consisting of a light-sensitive film unit comprising at least a light-sensitive silver halide emulsion layer and a non-diffusible dye giving compound associated with the light-sensitive silver halide emulsion layer. The retarding layer allows a first high pH value to be maintained during a first time interval which is sufficient and necessary for producing the desired image density in the image receiving layer and thereafter a second low pH value to be adjusted within a second time interval which is less than half as long as the first. Suitable polymers for the retarding layer are homo-, co- and graftpolymers of 1,2-dimethoxyethylene.

1 Claim, 4 Drawing Figures

DIFFUSION RETARDING LAYERS COMPRISING POLYMERS OF DIMETHOXYETHYLENE

This invention relates to a material for producing colour photographic images by the dye diffusion transfer process and in particular to a neutralisation system for such a material, consisting of an acid polymer layer and a retarding layer which slows down the fall in pH.

The dye diffusion transfer process is normally carried out using a light-sensitive element which contains dye-giving compounds and an image receptor element in which the desired colour image is produced by diffusible dyes which are transferred imagewise. Firm contact must be established between the light-sensitive element and the image receptor element, at least during a finite period within the development time, so that the imagewise distribution of diffusible dyes obtained in the light-sensitive element as a result of development can be transferred to the image receptor element. This contact may be established either before or after development begins. Contact is usually established before the onset of development in the case where, for example, a material in which the light-sensitive element and the image receptor element form an integral unit is used for carrying out the dye diffusion transfer process. Embodiments of the dye diffusion transfer process are known in which such an integral unit persists even after completion of the development process, that is to say the light-sensitive element is not separated from the image receptor element even after the colour has been transferred. One such embodiment has been described, for example, in DT-OS No. 2,019,430. According to another embodiment, the image receptor element which carries the complete image after transfer of the colour can be separated from the light-sensitive element, for example by means of a stripping layer arranged between the two elements. Such an arrangement has been described, for example, in DT-OS 2,049,688.

When the light-sensitive element has been exposed imagewise, it is treated with an alkaline developer preparation to develop the silver halide and produce an imagewise distribution of the diffusible dyes, which is then transferred to the image receptor element. As a general rule, the material is not subsequently washed but the high pH reached in the image receptor layer during development must be lowered in order finally to fix the image dyes in the image receptor layer and effectively terminate the development process. This is particularly important if the image receptor element and light sensitive element together form an integral unit or so-called monosheet. Known measures for reducing the pH consist of arranging a so-called neutralisation system close to the image receptor layer. This neutralisation system consists of a neutralisation layer containing a polymer with free acid groups and a retarding layer which slows down the rate of neutralisation and which contains a polymer which offers a certain resistance to the diffusible hydroxyl ions. One such neutralisation system has been described, for example, in DT-PS No. 1,285,310.

The polymer used in the retarding layer and its permeability to diffusible hydroxyl ions are particularly important for obtaining optimum results. The photographic material should give consistent results even under varying operating temperatures. The permeability of a polymer layer which is water-soluble and swells in water, for example a layer of polyvinyl alcohol, normally increases with increasing temperature. As a result, at higher operating temperatures the fall in pH in the monosheet takes place too rapidly so that insufficient colour densities are obtained in the image receptor layer. On the other hand, the rate of fall of pH is reduced too much if the operating temperatures are too low and consequently development is not stopped in good time. This results in fogging and insufficient colour balance. Moreover, the dyes which are transferred remain exposed to alkali for too long so that they are liable to be destroyed and the transferred image is liable to lose its sharpness. According to DT-PS No. 1,191,688, this fault can be corrected if the polymer used in the retarding layer is one which has an inverse relationship between permeability and temperature, i.e. in which the permeability for hydroxyl ions decreases with increasing temperature. Such polymers have been described, for example, in DT-PS No. 1,191,688, U.S. Pat. No. 3,421,893 and U.S. Pat. No. 3,455,686.

Cyanoethylated polyvinyl alcohol has also been proposed as a polymer for the retarding layer (US-PS 3,419,389). The permeability of this polymer is substantially independent of the temperature. This has the particular advantage that material containing this polymer can also be processed at low temperatures of about 10° C.

If the neutralisation system in the monosheet is not directly adjacent to the image receptor layer but remote from the light-sensitive layers in the light-sensitive element, the retarding layer must be even more sensitive in its time control function, that is to say, for example, the layer which is initially a barrier to $OH^-$ ions should become completely permeable to $OH^-$ ions after a specific latent period which should be substantially independent of the temperature, and it must be so permeable that the pH can fall within a few minutes from about 13–14 to about 7–9, if necessary with the assistance of an acid polymer layer which undergoes severe swelling in the course of neutralisation. The known polymers hitherto used in retarding layers do not satisfy these requirements. The retarding effect of the known retarding layers is obviously due to the fact that the polymers used in them offer a certain resistance to the diffusion of hydroxyl ions, and this resistance may depend on the given state of hydration. However, a certain retarding effect still appears to exist in the completely hydrated state, as can be seen from the fact that the reduction in pH proceeds too slowly. On the one hand, the high pH required for development and dye diffusion is not maintained for sufficiently long. On the other hand, after development has been completed, the pH does not fall sufficiently rapidly to such a low value that the transferred colour image is sufficiently stabilised and development and rediffusion of additional quantities of dye are effectively prevented. The dependence of the permeability of known polymers on the temperature is based on the dependence of the rate of diffusion of hydroxyl ions in the given polymer on the temperature. Satisfactory results can therefore be obtained with the known retarding layer polymers only if certain conditions are observed and, in particular, if the correct operating temperature is maintained. In particular, the known barrier layer polymers are not suitable for universal application of the corresponding neutralisation systems, and their composition must be adapted in each case to the particular colour producing systems and the arrangement of layers.

SUMMARY OF THE INVENTION

It is an object of this invention to provide a neutralisation system for the dye diffusion transfer process which keeps the pH in the image receptor layer virtually unchanged at its original high level during the necessary time required for development, which depends on the operating temperature, and then lowers it very rapidly to a level at which any further development or diffusion of dyes is effectively prevented. In particular, the neutralisation system should maintain its function over a wide temperature range of between 0° C and 40° C and produce transfer images of consistent quality.

It has now been found that retarding layer polymers which function in a completely novel manner are particularly suitable for this purpose. The polymers used in the retarding layer according to the invention are capable of being hydrated. In the non-hydrated state, they are impermeable to diffusible hydroxyl ions and in the hydrated state they are completely permeable to diffusible hydroxyl ions. Owing to this very marked behaviour, the retarding layer according to the present invention will hereinafter also be referred to as a temporary barrier layer. In contrast to the polymers used according to the invention, the known retarding layer polymers, insofar as they are capable of being hydrated at all, do not have a complete barrier action in the non-hydrated state and are not completely permeable to diffusible hydroxyl ions in the hydrated state.

This invention relates to a neutralisation system for the dye diffusion transfer process, comprising a neutralisation layer comprising a polymer which contains free acid groups and a retarding layer, which retards neutralisation, comprising a polymer which is capable of being hydrated and which acts as a barrier to diffusible hydroxyl ions, this barrier function being predominantly independent of the temperature or inversely related to the temperature, characterised in that the barrier effect against hydroxyl ions produced by the polymer or polymer mixture in the retarding layer is powerful during an initial period under the action of developer alkali, preferably at least one minute, and then becomes negligible during a second period as a result of hydration, this second period being less than half as long as the first period.

For characterising the behaviour of retarding layers a quotient $q$ may be defined as follows:

$$q = \frac{\text{barrier time of non-hydrated polymer}}{\text{barrier time of hydrated polymer}}$$

The quotient $q$ may be determined as described hereinafter in Example 8 by determining the time of indicator response for each the hydrated and non-hydrated state of the polymer and forming the quotient. Polymers that are useful for retarding layers according to the present invention are those which have a quotient $q$ of at least 10.

The initial period mentioned above corresponds to the time required to convert all the retarding layer polymer throughout the thickness of the retarding layer from the non-hydrated (barrier) state into the hydrated (permeable) state. This conversion is produced mainly by the aqueous developer preparation acting on the retarding layer from the side remote from the neutralisation layer. Consequently, the thicker the layer, the longer is the barrier time. However, the thickness of the barrier layer must not be increased indefinitely but should be kept as small as possible and preferably not greater than 20μ . The reason is that the amount of water needed for throughout hydration or swelling of the retarding layer increases with the thickness of that layer and, therefore, the amount of the processing liquid needed would be the higher the greater the thickness of the retarding layer. This again could cause difficulties in the monosheet material as any humidity should be disposed of as soon as possible. Another reason is that a retarding layer which is arranged opposite to the image-receiving layer due to its swellability would strongly interfere with the diffusion of dyes into the image-receiving layer. Lastly, too thick a retarding layer would cause an undesired tendency to curl up. Suitable barrier layer polymers are therefore selected according to a certain definition of the velocity of hydration. The velocity of hydration means the velocity with which the boundary between the hydrated and unhydrated states of the polymer migrates through the retarding layer under the influence of the aqueous developer preparation under normal conditions. For particularly suitable polymers, this velocity of hydration is between 2 and 10μm per minute. Examples of particularly suitable retarding layer polymers according to the present invention are homopolymers, copolymers and graft polymers of 1,2-dimethoxyethylene. These polymers are characterised by recurring structural units of the formula (I):

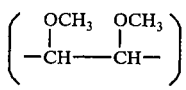

(I)

DETAILED DESCRIPTION OF THE INVENTION

Figure 1:
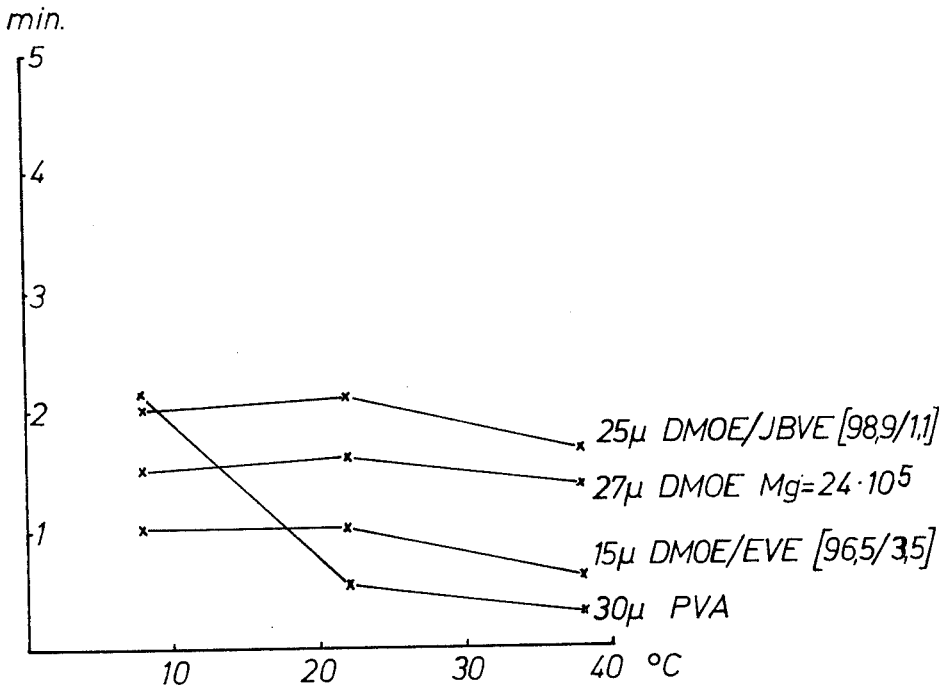
FIGS. 1–4 are graphical representations of results obtained in the following Examples.

Suitable barrier layer polymers include, for example, pure polydimethoxyethylene (molecular weight $1.10^5$ – $4.10^5$) and copolymers of 1,2-dimethoxyethylene with copolymerisable vinyl compounds, in particular alkyl vinyl ethers. The following comonomers, for example, are particularly suitable:

methyl, ethyl or isobutyl, vinyl ethers, e.g. in quantities of 0.5 to 15 mol %;

methoxy ethoxyethylene, e.g. in quantities of 1 to 20 mol %; and 3,4-dimethoxy-3-butenyl acetate, e.g. in quantities of 1 – 15 mol %.

The preparation of pure poly-1,2-dimethoxyethylene has been described in a process for the polymerization of 1,2-dimethoxyethylene using halogen containing organo aluminum compounds as polymer initiators. Polydimethoxyethylenes having a molecular weight in excess of 60,000 have been prepared.

It has been found that DMOE is very difficulty soluble in aliphatic hydrocarbons in the temperature range $\leqq -30°$ C. The monomer can thus be polymerized in suspension to special advantage by the use of the organo-metallic compounds, and low-boiling liquid hydrocarbons such as propane or butane are preferred as suspension agents for the monomer. In this case the poly-DMOE is immediately produced in a rubber-like form and can easily be obtained after removal of the suspension agent by evaporation.

The ratio of the monomer to the suspension agent is best from 1:2 to 1:3. If the ratio is substantially higher (say, 1:1), the polymerization still takes place under good control, but products of low molecular weight are formed and the transformation is not improved.

The quantity of the initiators advantageously amounts to between 0.1 and 10 mole-percent, and it is preferably between 1 and 6 mole-percent with reference to the monomers.

The polymerization temperature can be between 0° and −80° C., and it is preferably between −30° and −60° C.

The most advantageous polymerization temperature is between −40° and −55° C. In spite of the melting point of the monomer (85–90% cis-DMOE and 15–10% trans-DMOE) of about −30° C., it is possible to keep the DMOE dispersed in liquid form at −50° C. until the initiator is added. For safety's sake (to prevent premature crystallization), a small amount (say, 2%) of trimethoxyethane can be added to lower the freezing point. The addition of trimethoxyethane does not have a negative influence on the transformation and molecular weight. Temperatures substantially lower than −60° C. can be used with only difficulty reproducible results because the danger exists that the monomer might crystallize out before the initiator is added and the polymerization has begun. Polymerization temperatures higher than −40° C. have a decided effect on the molecular weights of the products obtained; thus the selection of the temperature offers a simple way of controlling the molecular weight.

The polymerization speed and the final transformation are not greatly dependent upon the initiator concentration, but the molecular weights are more greatly affected thereby. At an initiator concentration of 5 mole-percent with reference to the monomer the molecular weights attain the highest values.

The polymerization time, under the polymerization conditions described above, is between 2 and 4 hours. It is best for the course of the polymerization to be such that, at −50° C. in a propane or butane suspension, most of the polymer (80%-85%) is obtained in 1 to 2 hours of reaction time, and then, after the evaporation of the suspending agent at −45° and 0° C., respectively, the batch continues to be polymerized at the latter temperature (virtually in substance) down to the final degree of transformation. The polymerization is terminated by destroying the catalyst by the addition of alcohol.

The DMOE monomer was obtained from trimethoxyethane by splitting off methanol catalytically in the gaseous phase and consisted, on the basis of gas chromatography, of 85 to 90% cis-DMOE and 10 to 15% trans-DMOE.

The polydimethoxyethylenes obtainable by the invention are colorless, in contrast to the products prepared with $BF_3$ etherate.

The molecular weights (osmotic numerical average) amount to from 60,000 to 350,000 and more. Polymers with molecular weights of 80,000 to 270,000 are preferred for a number of applications.

As molecular weight comparisons of the numerical average values with the weight average values show, they have a narrow molecular weight distribution.

As X-ray diagrams show, the polydimethoxyethylenes obtainable by the process of the invention have a definite crystallinity, the crystalline percentage being about 10%. In contrast, the polymers obtained with $BF_3$ etherate are described in the literature as amorphous. The copolymers according to the invention may be prepared in a similar manner, using the catalysts indicated in that specification and polymerising in the presence of the appropriate quantities of comonomer.

The retarding layer polymers which have the new permeability properties required according to the invention may be used to build up neutralisation systems which, when used in photographic materials for the dye diffusion transfer process, are particularly effective in ensuring the development of the light-sensitive layers and formation of the colour image in the image receptor layer during an initial interval by maintaining the initial (high) pH for a first interval. The pH is then lowered during a second, very short interval of time, which is preferably less than half as long as the first, to a value at which development and diffusion of the dyes can no longer take place. The important factor is that the transition from high pH to the lower pH should take place as rapidly as possible. The particular pH values required depend on the given silver halide emulsions, on the reversal process employed and on the dye-giving compounds. The first pH is generally higher than 11, in individual cases even higher than 12 and preferably between 13 and 14. The second pH is generally lower than 9. Depending on the nature of the groups which render the diffusible dye soluble, it may be necessary to reduce the pH to values below 8 or in individual cases below 7 to fix the dyes finally.

In addition, the polymers suitable for the purpose of the invention have the advantageous property that their permeability to diffusible hydroxyl ions is largely independent of the temperature or even inversely related to the temperature, depending on their composition. In other words, the barrier time is largely independent of the operating temperature or increases slightly with increasing temperature.

The neutralisation system according to the invention may be used in an image receptor sheet for the dye diffusion transfer process if means are provided for separating the image receptor sheet from the light-sensitive material after development. The preferred and major application of the neutralisation system according to the invention, however, lies in its use in dye diffusion transfer materials of the integral type, i.e., in monosheet materials in which the image receptor element is not separated from the light sensitive element after transfer of the image dyes.

A suitable monosheet material for carrying out the dye diffusion process according to the invention may, for example, comprise the following layer elements:

(1) A transparent layer support,
(2) an image receptor layer,
(3) a light-impermeable layer,
(4) a light-sensitive element comprising at least one light-sensitive silver halide emulsion layer and at least one dye-giving compound associated therewith,
(5) a retarding layer,
(6) an acid polymer layer,
(7) a transparent layer support, The monosheet material may be built up by first preparing two different parts separately from each other, namely the light-sensitive part (layer elements 1 – 4) and the covering sheet (layer elements 5 – 7) and then placing the two parts together face to face and bonding them, if desired with the interposition of spacer strips to leave room between the two parts for an accurately measured quantity of processing liquid. If desired, the layer elements 5 and 6 which together form the neutralisation system may also alternatively or additionally be arranged between the layer support and image receptor layer of the light-sensitive part, but in the reverse sequence.

Means may be provided for introducing a processing liquid between two adjacent layers of the monosheet material, for example in the form of a container which can be split open and is arranged at the side of the material. When mechanical forces act on this container, it releases its contents between two adjacent layers of the monosheet material, in the present case between the light-sensitive part and the covering sheet.

The alkaline processing phase adjusts the lightsensitive material to a relatively high pH (about 11 to 14) which causes development and imagewise diffusion of dye. It has been found that the dyes and layers and hence the images obtained are not particularly stable at such a high pH. It is therefore necessary to adjust the material almost to neutral or only slightly acid after development has been completed. This is achieved in known manner by providing the material with an additional acid polymer layer (layer element 7) which becomes accessible for the alkaline processing compound only gradually in the course of development. An acid polymer layer means a layer of binder containing polymeric compounds which have acid groups, preferably sulpho or carboxyl groups. These acid groups react with the cations of the processing preparation to form salts and thus lower the pH of the preparation. The polymeric compounds and hence the acid groups are, of course, incorporated in the said layer in such a way that they are resistant to diffusion. The acid polymers are usually derivatives of cellulose or derivatives of which contain free carboxyl groups, e.g. cellulose dicarboxylic acid semiesters which contain free carboxyl groups, such as cellulose acetate hydrogen phthalate, cellulose acetate hydrogen glutarate, ethyl cellulose acetate hydrogen succinate or cellulose acetate hydrogen succinate hydrogen phthalate; ethers and esters of cellulose modified with other dicarboxylic acid anhydrides or with sulphonic acid anhydrides, for example with o-sulphobenzoic acid anhydride; carboxymethylcellulose, polystyrene sulphonic acid, polyvinyl hydrogen phthalate, polyvinyl acetate hydrogen phthalate, polyacrylic acid, acetals of polyvinyl alcohol with aldehydes which are substituted with carboxyl or sulpho groups, such as o-, m- or p-benzaldehyde sulphonic or carboxylic acid, partially esterified copolymers of ethylene and maleic acid anhydride, partially esterified copolymers of methyl vinyl ether and maleic acid anhydride and the like.

The acid polymer layer must contain sufficient acid groups to lower the initial pH of the processing compound of 11 to 14 to a level at which the material is finally almost neutral or only slightly acid (pH 5 to 8).

The latent period before the reduction in pH is achieved in known manner by coating the acid polymer layer with a so-called retarding layer. In the present case, this contains a polymer which has the permeability characteristics towards diffusible hydroxyl ions which are required according to the invention and which, together with the acid polymer layer, forms the neutral neutralisation system according to the present invention. It is obvious that the retarding layer must be arranged between the acid polymer layer and image receptor layer. The retarding layer according to the invention is preferably prepared by casting the appropriate polymer from an aqueous solution and then drying. The thickness of the retarding depends on the required retarding time (development time) and is generally between 2 and 20 $\mu$.

An important part of the photographic material according to the present invention is the light-sensitive element, which in the case of a dye diffusion transfer process contains a light-sensitive silver halide emulsion layer and an associated dye-giving compound. This compound may be situated in a layer adjacent to the silver halide emulsion layer or it may be contained in the silver halide emulsion layer itself. In the latter case, the colour of the image dye is preferably chosen so that most of its absorption range does not coincide with the main range of sensitivity of the silver halide emulsion layer. For producing multi-coloured transfer images in colours true to life, the light-sensitive element contains three such arrangements of dye-giving compound and light-sensitive silver halide emulsion layer. As a rule the absorption range of the dye-giving compound substantially coincides with the range of spectral sensitivity of the associated silver halide emulsion layer. In order to obtain the greatest possible sensitivity, it is then necessary to arrange the dye-giving compound in a separate layer of binder behind the silver halide emulsion layer (viewed in the direction of the incident light used for exposure).

The developer oxidation products of the development of a silver halide emulsion must, of course, affect only the associated dye-giving compound. The light-sensitive element is therefore generally provided with separating layers which prevent diffusion of the developer oxidation products into other layers not associated with this emulsion layer. These separating layers may, for example, contain suitable substances which react with the developer oxidation products, for example non-diffusible hydroquinone derivatives, or non-diffusible colour couplers if the developer compound is a colour developer compound.

In the silver halide emulsion layers or in adjacent layers, the light-sensitive element contains substances which take part in the development process to bring about imagewise distribution of a diffusible image dye. These substances will hereinafter be referred to as dye-giving compounds. In principle, any type of compound which gives rise to diffusible dyes on development of the light-sensitive element may be used for this purpose. The dye-giving compounds may be capable of diffusion. In this case they start to diffuse when the layers are treated with an alkaline processing liquid and are then fixed by development only in the exposed areas. On the other hand, the dye-giving compounds may be diffusion-resistant and release a diffusible dye in the course of development.

Dye-giving compounds which are diffusible from the start have been disclosed, for example, in German Patent Specifications Nos. 1,036,640, 1,111,936 and 1,196,075. The so-called dye developers described in these Patent Specifications contain in one and the same molecule a dye residue and a group which is capable of developing exposed silver halide.

Among the known processes for producing coloured photographic images by dye diffusion transfer, increasing importance has recently been attached to those which are based on the use of diffusion-resistant dye-giving compounds from which diffusible dyes or dye precursors are split off imagewise in the course of development and transferred to an image receptor layer.

Dye-giving compounds suitable for these processes include, for example, the non-diffusible colour couplers described in DT-PS 1,095,115, which react with the oxidation product produced by development from the colour developer compound which consists of a primary aromatic amine to release a dye in diffusible form. This dye is either preformed or produced by colour coupling. The choice of suitable developer compounds in this case is, of course, restricted to colour developers.

Also relevant in this context are the non-diffusible dye-giving compounds described in DT-OS No. 1,930,215, which contain a preformed, latently diffusible dye residue attached to a group which makes it diffusion resistant through a hydrazone group which can be split. These compounds should not be referred to as colour couplers and it has also been found that the choice of developer compounds required to liberate the diffusible dye residue is by no means restricted to the usual colour developers but may very well include black-and-white developers, e.g. pyrocatechols.

In DT-OS No. 1,772,929, coloured compounds containing a special grouping have been described, which enter into an oxidative ring closure reaction on development, thereby liberating a preformed dye residue in a diffusible form. The compounds mentioned in the said last mentioned documents can be divided into two groups. The compounds of the first group require a conventional colour developer compound for development. They couple with the oxidation product of this colour developer and in a subsequent ring closure reaction they liberate the preformed dye residue in a diffusible form. Compounds of the second group are themselves silver halide developers and are therefore capable of undergoing the above mentioned ring closure reaction in the oxidised form to liberate the diffusible dyes even in the absence of other developer compounds.

Finally, there should be mentioned in this context the non-diffusible dye-giving compounds of DT-OSA No. 2,242,726. These compounds are sulphonamidophenols and sulphonamidoanilines which are decomposed by the action of the alkali of the developer after the oxidation reaction of development, and thus liberate a diffusible dye.

The dye-giving compounds mentioned above all without exception operate negatively, i.e. when conventional (negatively operating) silver halide emulsions are used, the imagewise distribution of the liberated diffusible dye corresponds with the negative silver image produced on development. To obtain positive colour images it is therefore necessary to use direct positive silver halide emulsions or a suitable reversal process.

One such reversal process is the silver salt diffusion process. Photographic reversal with the aid of the silver salt diffusion process to produce positive colour images using conventional colour couplers has already been described, for example, in U.S. Pat. No. 2,763,800. If the colour coupler is replaced by the dye-giving compounds mentioned above, a light-sensitive element suitable for the dye diffusion transfer process is obtained. One such light-sensitive element, for example, comprises at least one combination of a light-sensitive silver halide emulsion layer and an associated layer of binder which contains development nuclei for physical development and a dye-giving compound.

In the development process, the exposed parts of the silver halide in the light-sensitive silver halide emulsion layer are developed chemically. The unexposed parts are transferred into the associated layer of binder which contains development nuclei by means of a silver halide solvent and are physically developed there. If physical development is carried out with a developer which, in its oxidised form, is capable of liberating a diffusible dye as a result of a reaction with a dye-giving compound present in this layer, then an imagewise distribution of diffusible dyes is obtained, and this distribution is transferred to an image receptor layer where it forms a positive colour image.

In a reversal process using compounds which split off development inhibitors in an imagewise distribution, the light-sensitive element consists of at least one layer combination comprising a light-sensitive silver halide emulsion layer and a second emulsion layer which is developable without exposure and which contains the dye-giving compound. The light-sensitive silver halide emulsion layer is developed, for example, with colour developers in the presence of certain compounds which react with oxidised colour developers to split off development inhibiting compounds. The development inhibiting compounds liberated imagewise in the light-sensitive layer diffuse into the adjacent emulsion layer which is developable without exposure, where they inhibit development imagewise. At the same time, the uninhibited (positive) portions of the emulsion layer which is developable without exposure are developed by the remaining developer whose oxidation products then react with the non-diffusible dye-giving compounds according to the invention to liberate diffusible dyes which are transferred imagewise to the image receptor element. Suitable compounds which split off development inhibiting compounds in their reaction with colour developer oxidation products are, for example, the known DIR couplers (DIR = development inhibitor releasing). These are colour couplers in which an inhibitor group which is capable of being split off is present in the coupling position. Such DIR couplers have been described, for example, in U.S. Pat. No. 3,227,554.

Another group of compounds which react with colour developer oxidation products to split off development inhibiting compounds has been described in U.S. Pat. No. 3,632,345. These compounds are not colour couplers and accordingly no dyes are formed when the development inhibiting compounds are released. Very similar compounds have also been described in DT-OS No. 2,359,295. According to DT-PS No. 1,229,389, suitable substituted, non-diffusible hydroquinone compounds may also be used in such a process; these compounds are oxidised by developer oxidation products to the corresponding quinones and split off development inhibiting mercaptans.

The direct positive silver halide emulsions used may in principle be any emulsions of this kind which can undergo simple development to produce a positive silver image and an imagewise distribution of developer oxidation products corresponding to this image. Suitable silver halide emulsions include, for example, those in which a developable fog which has been produced by exposure or chemical treatment is destroyed imagewise when the emulsion is exposed imagewise under certain conditions. The fog is preserved in the unexposed areas so that, when the emulsion is subsequently developed there is obtained a direct positive silver image and, corresponding therewith, an imagewise distribution of the diffusible dye if a dye-giving compound is associated with this direct positive silver halide emulsion.

Another group of direct positive silver halide emulsions which are advantageously used according to the invention includes the so-called unfogged direct positive silver halide emulsions in which the sensitivity to light is situated mainly in the interior of the silver halide grains. When these emulsions are exposed imagewise, a latent image is formed mainly in the interior of the silver halide grains. Development of such unfogged direct positive silver halide emulsions is carried out under fogging conditions. A fog is produced mainly in the unexposed areas and a positive silver image is obtained on development. The unfogged direct positive silver halide emulsions are characterised by the fact that when exposed samples are developed with a typical surface developer of the following composition:

| | |
|---|---|
| p-hydroxyphenylglycine | 10g |
| sodium carbonate (crystallised) | 100g |
| made up with water to | 1000ml |

they preferably do not give rise to a silver image, or only one with a very low density, whereas when they are developed with an internal nuclear developer of the following composition:

| | |
|---|---|
| hydroquinone | 15g |
| monomethyl-p-aminophenolsulphate | 15g |
| sodium sulphiate (anhydrous) | 50g |
| potassium bromide | 10g |
| sodium hydroxide | 25g |
| sodium thiosulphate (crystallised) | 20g |
| made up with water to | 1000ml |

a silver image with sufficient density is obtained.

Selective fogging of the unfogged direct positive emulsions which have been exposed imagewise may be carried out by treating the emulsions with a fogging agent either before or during development. Suitable fogging agents are, for example, hydrazine or substituted hydrazines (see, for example, U.S. Pat. No. 3,227,552).

Unfogged direct positive emulsions include, for example, those which have faults in the interior of the silver halide grains (U.S. Pat. No. 2,592,250) or silver halide emulsions with a layered grain structure (DT-OS No. 2,308,239).

The light impermeable layer arranged underneath the light-sensitive element is permeable to aqueous alkaline treatment solutions and hence to the diffusible dyes. It has two main functions. First, it serves to screen off the image silver which remains in the original light-sensitive element after exposure and the dye-giving compounds which are left behind as colour negatives so that when the material is viewed through the transparent layer support of the light-sensitive element, only the positive colour transfer image is visible; second, it screens the light-sensitive element on the side of the image receptor layer (at the bottom) so that no light can get to it. This is particularly important if after exposure the monosheet material is brought into contact with the alkaline processing substance while it is still inside the camera and then removed from the camera to be developed outside.

Layers which are sufficiently impermeable to light but sufficiently permeable to diffusible dyes may be prepared, for example, with the aid of suspensions of inorganic or organic darkening substances, preferably black pigments, for example suspensions of carbon black in suitable binders, e.g. in gelatine solutions. To ensure the necessary exclusion of light during development, it is generally sufficient to use layers with thicknesses of 0.5 to 2 $\mu$ which contain from 10 to 90% by weight (based on the total dry weight) of carbon black in gelatine. The particle size of the pigments used is relatively uncritical provided it is not substantially greater than 0.5 $\mu$.

The light impermeable layer preferably has a white pigment layer arranged underneath the black pigment layer. The object of this white pigment layer is to cover the black layer and to provide a white background for the image. Any white pigments are suitable for this purpose provided they have sufficient covering power in layers which are not unduly thick. Suitable pigments include, for example, barium sulphate, oxides of zinc, titanium, silicon, aluminium or zirconium, barium stearate or kaolin. Titanium dioxide is the white pigment preferably used. The same particulars apply as for the black pigments with regard to the binder, the concentration and the particle size. The thickness of the white pigment layer may be varied according to the desired whiteness of the background. Thicknesses of between 2 and 10 $\mu$ are preferably employed.

Instead of the light-impermeable layer, the monosheet material according to the invention may also contain means for producing such a light-impermeable layer between the light-sensitive element and the image receptor layer, e.g. in the form of a container arranged at the side of the sheet and containing a liquid with a clouding or opacifying agent (pigment). When exposed to mechanical forces the container releases its contents between the said layers to form the pigment layer.

The image receptor layer consists substantially of a binder which contains the dye mordant for fixing the diffusible acid dyes.

The mordants for acid dyes are preferably long chain quaternary ammonium or phosphonium compounds or tertiary sulphonium compounds, e.g. those described in U.S. Pat. Nos. 3,271,147 and 3,271,148. Certain metal salts and their hydroxides which form sparingly soluble compounds with acid dyes may also be used. The dye mordants are dispersed in a conventional hydrophilic binder in the receptor layer, e.g. gelatine, polyvinyl pyrrolidone, partly or completely hydrolysed cellulose esters or the like. Some binders may, of course, function as mordants, e.g. copolymers or polymer mixtures of vinyl alcohol and N-vinylpyrrolidone as described, for example, in DT-AS No. 1,130,284, or those which constitute polymers of quanternary nitrogen bases, e.g. polymers of N-methyl-2-vinylpyridine as described, for example, in U.S. Pat. No. 2,484,430. Other suitable mordanting binders include, for example, quanylhydrazone derivatives or alkylvinylketone polymers as described, for example, in U.S. Pat. No. 2,882,156 or guanylhydrazone derivatives of acyl styrene polymers as described, for example, in DT-OS No. 2,009,498. In general, however, other binders, e.g. gelatine, would be added to the last mentioned mordanting binders.

The transparent layer supports used in the monosheet materials according to the invention may be any of the usual transparent support materials customarily used in photography, e.g. films of cellulose esters, polyethylene terephthalate, polycarbonate or other film-forming polymers.

After imagewise exposure, the light-sensitive element is processed with an aqueous alkaline developer preparation and brought into contact with the image receptor element. In the case of monosheet materials, the developer preparation is pressed between two layers of the monosheet. The developer preparation may contain developer compounds in addition to the aqueous alkali, but these must be adjusted to the nature of the dye-giving compounds. Other possible components of the developer preparation include thickeners for increasing the viscosity, such as hydroxyethylcellulose, silver halide solvents, e.g. sodium thiosulphate or one of the bissulphonyl alkane compounds mentioned in DT-OS No. 2,126,661, clouding agents for producing opaque layers, e.g. pigments of $TiO_2$, ZnO, barium stearate or kaolin. Alternatively or in addition, some of these components may be incorporated in one or more layers of the monosheet material. Thus, for example, according to one particularly preferred embodiment of the invention, non-diffusible developers are incorporated in layers of the light-sensitive element while the developer preparation itself contains only small quantities of a diffusible auxiliary developer. (See German Offenlegungsschriften Nos. 2,327,963 and 2,335,179.

EXAMPLE 1

Method of testing the polymers for their suitability in the retarding layers:

An aqueous solution of the polymer to be tested is cast on an untreated polyethylene terephthalate film support to form a thin film. When dry, the film is stripped off as a thin foil which is brought into close contact with a so-called indicator sheet. This consists of a paper support coated with a gelatine layer which contains an indicator dye capable of being mordanted and the corresponding mordant. A suitable mordant is, for example, octadecyl-trimethyl-ammonium methylsulphate and a suitable indicator dye which can be mordanted is an azo dye of the following formula:

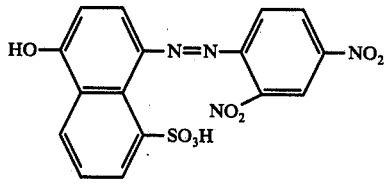

If an aqueous alkali hydroxyde solution slightly thickened with hydroxyethylcellulose is applied to the retarding layer foil, the indicator in the layer of mordant underneath it changes its colour after a certain time depending on the thickness of the foil and on its composition. The time interval between application of the alkali paste and the colour reaction in the indicator layer is a measure of the retarding action of the polymer in the retarding layer on the OH ions in the paste.

The following Table shows the retarding times of some polydimethoxyethylenes and dimethoxyethylene copolymers determined by the method described above. In this and in the following Examples, various polymers are described in terms of their monomers which are abbreviated as follows:

DMOE = dimethoxyethylene
EVE = ethylvinylether
IBVE = isobutylvinylether
MOEOE = methoxyethoxyethylene Table 1

| Polymer | Foil thickness [μ] | Retarding time [seconds] Indicator change from yellow to purple |
|---|---|---|
| Dimethoxyethylene (DMOE) Molecular weight approximately: $2.4 \times 10^5$ | 30 | 110 - 125 |
| $1.5 \times 10^5$ | 30 | 70 - 80 |
| $0.9 \times 10^5$ | 30 | 55 - 70 |
| DMOE/EVE (3.5 mol %) | 30 | 150 - 165 |
| DMOE/IBVE (1.1 mol %) | 30 | 155 - 165 |
| DMOE/IBVE (2.7 mol %) | 30 | 200 - 210 |
| DMOE/IBVE (5.0 mol %) | 30 | 300 - 315 |
| DMOE/IBVE (5.0 mol %) | 20 | 200 - 210 |
| DMOE/MOEOE (15 mol %) | 30 | 260 - 280 |
| DMOE/MOEOE (15 mol %) | 20 | 165 - 180 |

The figures given for the mol % in the brackets refer to the proportion of the comonomer. In another terminology (in particular in FIGS. 1 to 4) the mol % of all the monomers in the copolymer are given in square brackets separated from each by oblique strokes (/).

As can be seen from the Table, with layers of 30 μ in thickness, retarding times of up to 4½ minutes are obtained, depending on the comonomer, and the colour change is sharp and clearly defined.

EXAMPLE 2

One special advantage of this class of polymers is that the retarding effect is only very slightly dependent on the temperature. This is shown by the retarding curves in FIG. 1. While the retarding time for OH ions remains practically constant within the temperature interval of 8° C to 22° C, it decreases slightly towards higher temperatures (40° C) but to such a limited extent that the usefulness of the polymer is in no way impaired. FIG. 1 shows the dependence of the retarding time (~ initial time interval) on the temperature for various polymers.

EXAMPLE 3

Figure 2:
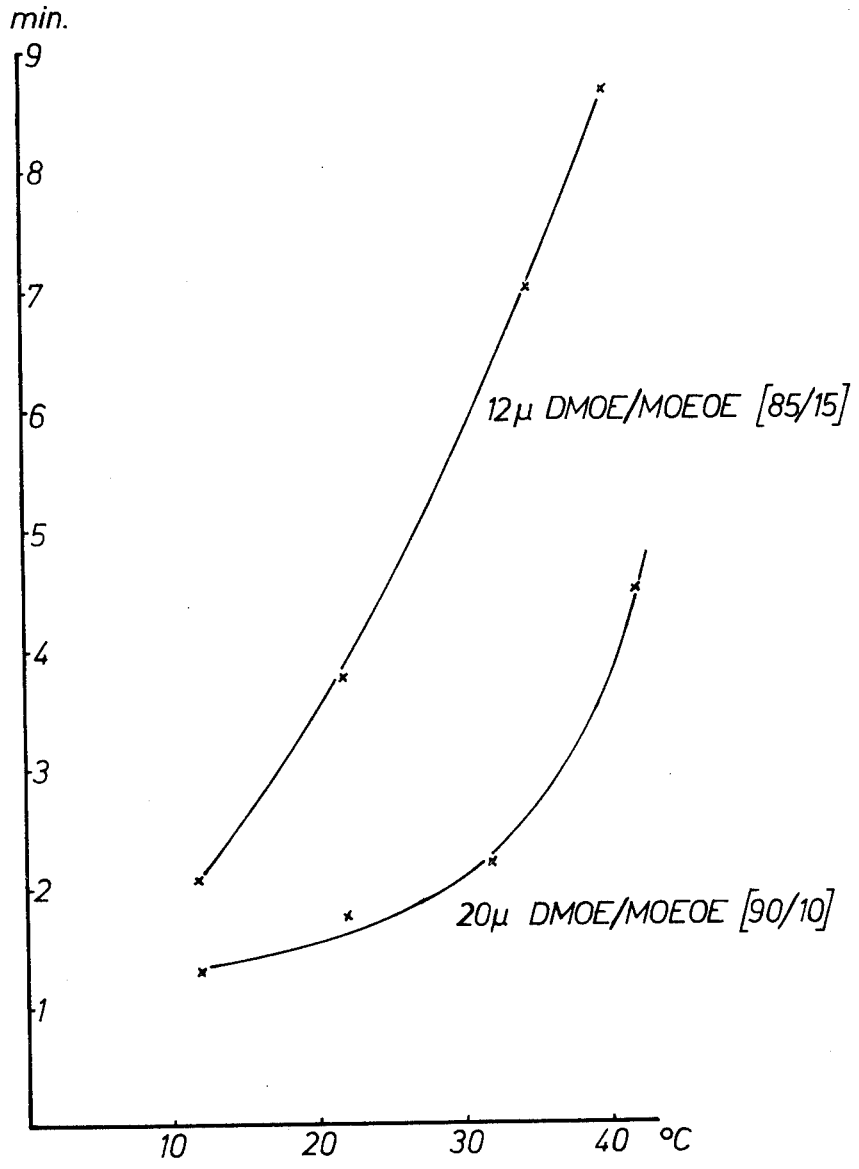

The temperature characteristic of copolymers of DMOE and methoxyethoxyethylene (MOEOE) differs from that of the dimethoxyethylene copolymers in Example 2 (see FIG. 1) in that the retarding effect of the polymer film on OH ions increases with increasing temperature, that is to say the retarding function of this copolymer is truly inversely related to the temperature, as shown for DMOE/MOEOE (10 mol % and 15 mol %) in FIG. 2. (Determination of the retarding times was carried out as described in Example 1.)

It will readily be seen that any desired temperature characteristic of the retarding layer function can be obtained by using a suitable combination of this type of copolymer of DMOE and MOEOE (see Example 4).

EXAMPLE 4

The following foils are prepared with a thickness of 14 μm as described in Example 1:

(a) Poly-(dimethoxyethylene/methoxyethoxyethylene) DMOE/MOEOE (15 mol %) (Polymer A)

(b) Poly-(dimethoxyethylene/isobutylvinylether) DMOE/IBVE (5 mol %) (Polymer B)

Figure 3:
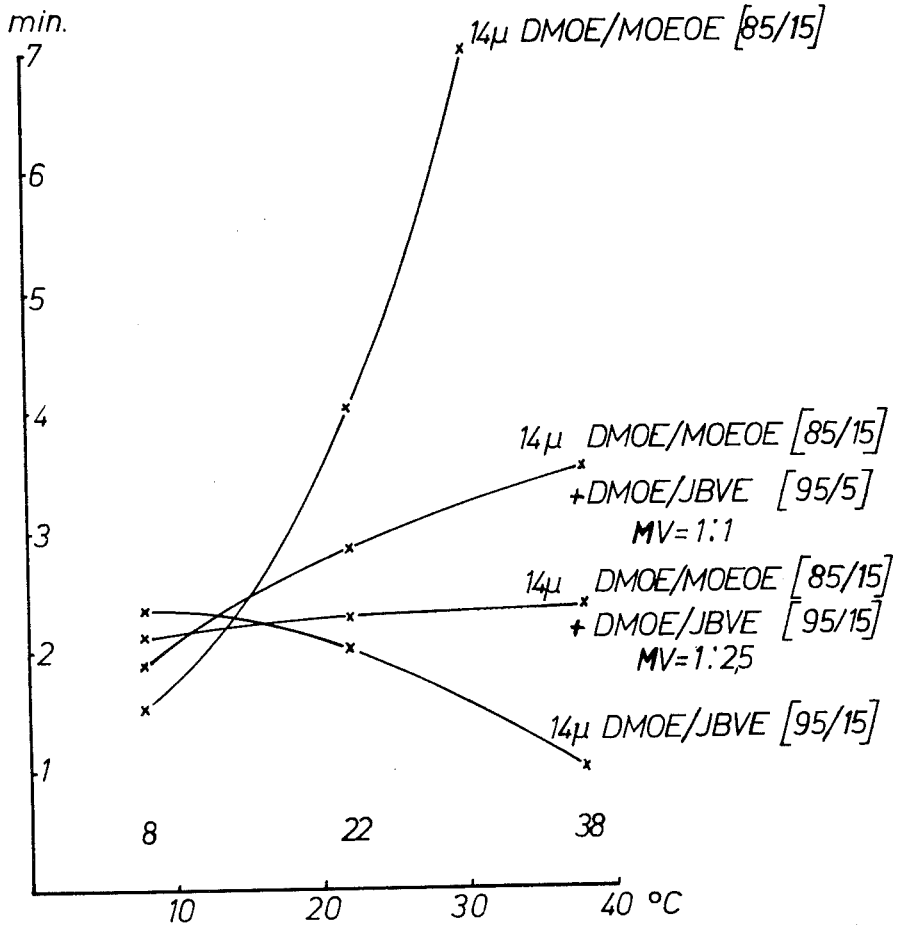

(c) 1 : 1 mixture of polymer A and polymer B (d) 1 : 2.5 mixture of polymer A and polymer B FIG. 3 shows the dependence of the retarding time (ordinate) on the operating temperature (abscissa). It will be seen that practically any relationship between temperature and retarding layer function can be obtained by suitably mixing various polymers.

EXAMPLE 5

A very special advantage of this class of polymers is their property of blocking the passage of OH ions for a quite specific and relatively long time, depending on their composition and on the thickness of the film. Thus, they block the passage of OH ions until the layer has swelled throughout, and thereafter are permeable to the stream of OH ions practically without resistance. This can be seen from the fact that after expiry of the so-called barrier time, neutralisation of the alkali in the paste is almost as rapid as if the paste were in direct contact with the acid polymer layer. This phenomenon is not found, for example, in retarding layers of terpolymer latices with or without admixture of a water-soluble polymer as described in DT-OS No. 2,319,723. In these layers, there is no detectable barrier period and the pH drops continuously and very slowly at a rate which is retarded by the layer out of proportion to its thickness. In layers of polyvinyl alcohol, on the other hand, the retarding time is much too short. This is demonstrated by the curves in FIG. 4.

Figure 4:
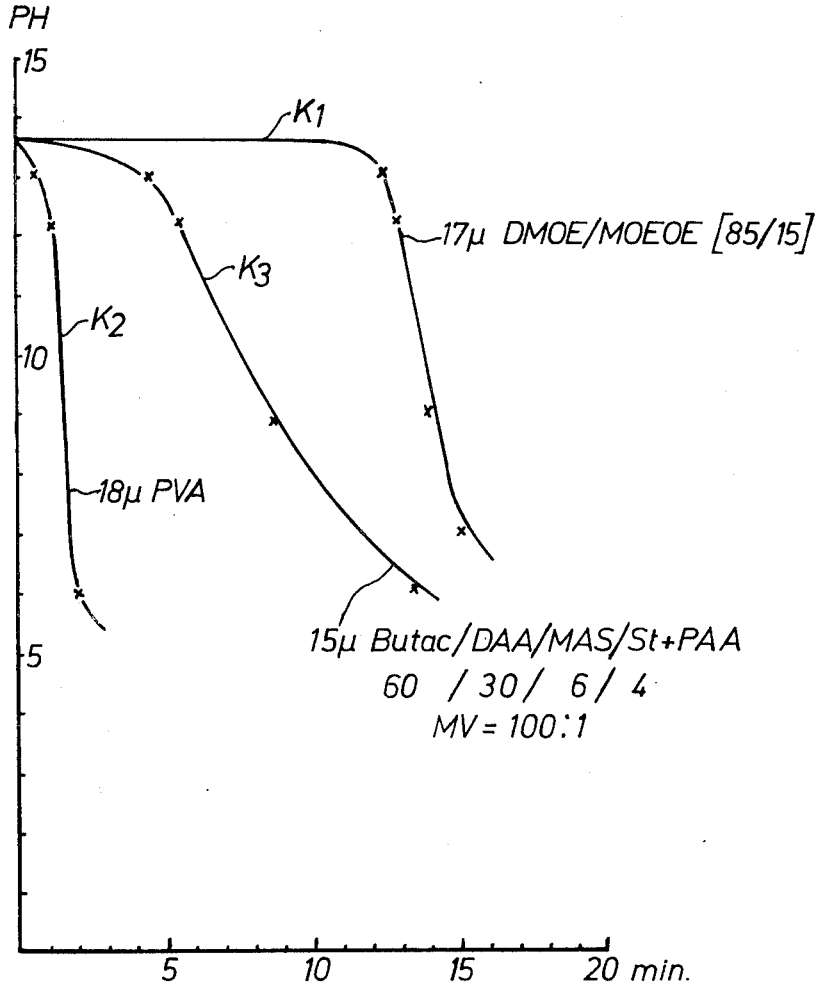

The curves in FIG. 4 are obtained with barrier layers of the following compositions:

(1) DMOE/MOEOE (15 mol %) copolymer of 85 mol % of dimethoxyethylene and 15 mol % of methoxyethoxyethylene; thickness of layer 17 μm (2) PVA = polyvinyl alcohol; thickness of layer 18 μm (3) Butac/DAA/MAS/St + PAA (100 : 1) Mixture of 100 parts of a copolymer of 60 parts of butyl acrylate, 30 parts of diacetonacrylamide, 6 parts of methacrylic acid and 4 parts of styrene with 1 part of polyacrylamide (according to DT-OS No. 2,319,723); thickness of layer 15 μm.

EXAMPLE 6

(A) Image element consisting of an image receptor layer containing a dye mordant, a light-reflecting layer and a light-sensitive unit. The following layers were applied successively to a transparent support of polyester foil:

1. A gelatine layer containing 4 g/m² of octadecyltrimethyl-ammonium-methylsulphate as a mordant, thickness of layer 10 μm;

2. A gelatine layer containing 50 g/m² of titanium dioxide treated with $SiO_2$ aquate - $Al_2O_3$ aquate (see DT-OS 2,324,590) as light-reflecting layer, layer thickness 15 μm;

3. A gelatine layer containing 0.8 g/m² of cyan component L (see annexe of formulae) and 0.6 g/m² of the non-diffusible colour developer 2-amino-5-(N-dodecyl-N-ω-sulphopropylamino)-toluene; layer thickness 2 μm;

4. A gelatine layer containing a red-sensitised, unfogged direct positive silver chlorobromide emulsion, silver application 1.8 g/m², layer thickness 1μm;

5. A gelatine layer containing 0.5 g/m² of octadecylhydroquinone sulphonic acid as a barrier layer for oxidised auxiliary developer, layer thickness 2 μm;

6. A gelatine layer containing 0.8 g/m² of magenta component M (see annexe of formulae) and 0.6 g/m² of non-diffusible colour developer 2-amino-5-(N-dodecyl-N-ω-sulphopropylamino)-toluene, layer thickness 2 μm;

7. A gelatine layer containing a green-sensitised, unfogged, direct positive silver chlorobromide emulsion, silver application 1.8 g/m², layer thickness 1 μm;

8. A barrier layer for oxidised auxiliary developer (identical to layer 5);

9. A gelatine layer containing 0.8 g/m² of yellow component N (see annexe of formulae) and 0.6 g/m² of non-diffusible colour developer 2-amino-5-(N-dodecyl-N-ω-sulphopropylamino)-toluene, layer thickness 2 μm;

10. A gelatine layer containing a blue-sensitised unfogged direct positive silver chlorobromide emulsion, silver application 1.8 g/m², layer thickness 1μm;

11. A protective gelatine layer, layer thickness 1 μm;

(B) Covering Sheet; the following layers were applied to a transparent foil of polyethylene terephthalate by dipping;

1. A bonding layer according to US-PS 3,794,513 in the form of a solution of:

10 ml of polymethacrylic acid methyl ester (molecular weight approximately 100 000) (10% in $CHCl_3$),
17.5 g of chloral hydrate,
30 ml of chloroform,
50 ml of dichloroethane,
0.1 ml of silicone oil PN 200 (10% in $CHCl_3$); silicone oil PN 200 is a polyphenylmethylsiloxane and is marketed by BAYER AG, Leverkusen;

2. An acid polymer layer consisting of a copolymer of acrylic acid and butyl acrylate in proportions of 45 : 55, thickness of layer approximately 28 μ;

3. A retarding layer for OH ions consisting of a copolymer of dimethoxyethylene and 5 mol % of isobutylvinylether, layer thickness approximately 15 μ. A strip of the image element (A) was exposed through a colour separation wedge and together with a bag of paste at one end of the film strip it was joined to the covering sheet (B) with its active side in contact with this sheet through two spacer strips 250 μ in thickness and 0.7 cm in width arranged at the sides to form a film unit.

The developer was a paste of the following composition:

2 g of sodium sulphite,
15 g of potassium hydroxide
10 ml of benzyl alcohol,
1 g of N,N,N',N'-tetramethyl-p-phenylenediamine,
1 g of acetylphenylhydrazine, and
35 g of hydroxyethylcellulose, made up with water to 1 liter.

The film unit was passed through a pair of squeezing rollers so that the developer paste was spread between the light-sensitive material and the covering sheet to form a layer 250 μm in thickness defined by the spacer strips. A multi-coloured positive copy of the original with a high colour density and good colour separation became visible within a few minutes through the transparent support of the image receptor layer, the $TiO_2$ layer serving as background. Due to the retarding layer on the covering sheet, neutralisation of the alkali sets in only after the negative has been developed and the dyes have been liberated imagewise, and once begun this neutralisation proceeds very rapidly owing to the particular functional characteristics of the retarding layer polymer already described (see Example 5). This is important in ensuring a good image quality. If the pH is lowered too slowly after the necessary latent period provided by the retarding layer for development of the negative, as in the case, for example, when the terpolymers described in U.S. Pat. No. 3,421,893 are used, the image whites are too heavily fogged (so-called development fog).

Another advantage of this retarding layer polymer is that the same good quality of image is obtained if development of the monosheet unit is carried out at low temperatures, e.g. at 8° C instead of 22° C. This is due to the fact that the function of the retarding layer is to a large extent independent of the temperature.

EXAMPLE 7

Light-sensitive element containing image receptor and reflection layer (1)

The following layers were applied in the given sequence and in the stated quantities per $m^2$ to a transparent film support of polyethylene terephthalate:

1. An image receptor layer of 3.8 g of octadecyltrimethylammonium monomethylsulphate and 9.5 g of gelatine;
2. an opaque, light-reflecting layer which is permeable to alkaline processing liquid and consists of 48.5 g of titanium dioxide and 4.85 g of gelatine;
3. a nuclear layer containing 1.32 g of a compound L which forms a cyan transfer dye (see annexe of formulae), 4.5 g of silver sulphide nuclei, 0.1 g of carbon black, 0.88 g of the developer 2-amino-5-(N-dodecyl-N-ω-sulphopropylamino)-toluene and 2.5 g of gelatine;
4. a red sensitive silver bromide emulsion layer of 2 g of gelatine, 1.1 g of silver, 0.37 g of the developer 2-octadecylhydroquinone and 1.23 g of the developer 2-octadecyl-5-sulphohydroquinone;
5. a separating layer of 3.9 g of gelatine and 0.18 g of the developer 2-octadecyl-5-sulphohydroquinone;
6. a nuclear layer containing 0.48 g of compound M which forms a magenta transfer dye (see annexe of formulae), 3.8 mg of silver sulphide nuclei, 0.76 g of the developer 2-amino-5-(N-dodecyl-N-sulphopropylamino)-toluene and 2.1 g of gelatine;
7. a green sensitive layer of gelatine and silver bromide emulsion consisting of 2 g of gelatine, 0.7 g of silver, 1.23 g of the developer 2-octadecyl-5-sulphohydroquinone and 0.37 g of the developer 2-octadecylhydroquinone;
8. a separating layer of 2.5 g of gelatine and 0.18 g of the developer 2-octadecyl-5-sulphohydroquinone;
9. a nuclear layer containing 0.85 g of compound N which forms a yellow transfer dye (see annexe of formulae), 4.2 mg of silver sulphide, 0.85 g of the developer 2-amino-5-(N-dodecyl-N-ω-sulphopropylamino)-toluene and 2.4 g of gelatine;
10. a blue sensitive gelatine/silver bromide emulsion consisting of 2g of gelatine, 0.9 g of silver, 1.23 g of the developer 2-octadecyl-5-sulphohydroquinone and 0.37 g of the developer 2-octadecyl-hydroquinone; and
11. a layer of 1.2 g of gelatine and 0.12 g of 1-phenyl-3-pyrazolidone.

Covering sheet containing neutralisation systems (2)

An acid polymer layer of the butyl semiester of a copolymer of ethylene and maleic acid anhydride (as described in U.S. Pat. No. 3,362,819) was first applied as a layer of about 20 μ in thickness to a transparent polyethylene terephthalate film support. It was then covered with a retarding layer about 18 μ in thickness of a copolymer of dimethoxyethylene and 5 mol % of isobutylvinyl ether.

If these two sheets 1 and 2 are placed with their active surfaces in contact with each other after the light-sensitive element has been exposed imagewise and if an alkaline processing solution which has the composition indicated below is then pressed between the two sheets in known manner, a multicoloured reproduction of the original is obtained on the white background within a few minutes.

The processing solution has the following composition:

25 g of NaOH
30 g of Natrosol HHR,
4.0 g of sodium sulphite,
2.0 g of sodium thiosulphate and
10 g of benzyl alcohol, made up with water to 1 liter.

If the two sheets 1 and 2 are left in contact with each other after development and then made into a so-called integral film unit by joining them together with Tesa film on all sides, a very rapid fall in pH of the alkaline paste distributed between the layers of the monosheet set takes place immediately after the exposed light-sensitive element has been developed. This stabilises the resulting image, particularly the image whites, that is to say they remain white and are not spoiled by a colour fog.

To obtain maximum colour layers, it is essential to maintain the initially high pH in the set during the time required for complete development of the negative. This ensures that the retarding layer will provide the necessary "barrier period" for OH ions which, as can be seen from FIG. 4, is most pronounced when using dimethoxyethylene (and its derivatives).

If, on the other hand, the retarding layer based on dimethoxyethylene is replaced by a latex retarding layer which contains polyacrylamide as described in DT-OS 2,319,723, and which has the following composition:

terpolymer latex of butyl acrylate/diacetonacrylamide/methacrylic acid/styrene 60/30/6/4 mixed with a high molecular weight polyacrylamide in proportions of 100:1, the densities of colour transfer are the same but, owing to the much slower fall in pH in the set (see FIG. 4), a heavy blue fog is formed after 1 to 2 hours' storage because the alkali induces liberation of dye not in accordance with the image.

Annexe of formulae to Examples 6 and 7

In the following formulae, Z denotes the following group:

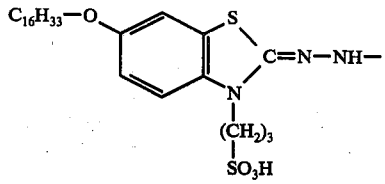

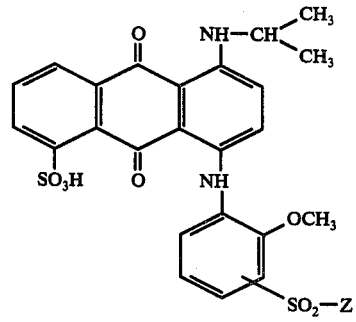

L

-continued

M

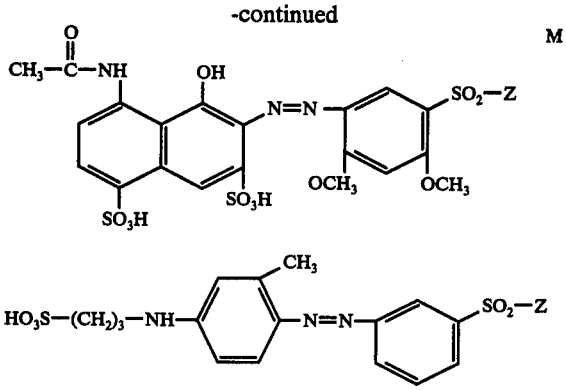

EXAMPLE 8

This example demonstrates that the nonhydrated retarding layers of the invention have maximum barrier effect and that the hydrated retarding layers have negligible barrier effect. This is in contrast to the retarding layers of the prior art as described for example in DT-OS No. 2 319 723 which contain latex polymers which in this respect show no difference between the hydrated and nonhydrated state.

The layers to be compared are prepared as described in example 1 by casting an aqueous solution of the polymer to be tested on an untreated polyethylene terephthalate film support. When dry the film is stripped off as a thin foil. In the case of the latex polymers the polyethylene terephthalate film support was first coated with a 1μ auxiliary layer of polyacrylamide. This polyacrylamide auxiliary layer is stripped off together with the latex polymer layer and adhers strongly to it. In assessing the retarding action of the latex polymer layer the influence of this polyacrylamide auxiliary layer can be neglected.

The layers to be compared are brought into contact with the indicator sheet described in example 1 to form a laminate structure. In the case of the latex polymer layer the polyacrylamide auxiliary layer faces the indicator sheet. One sample of each laminate structure is wetted with water of pH 7 until the polymer layer has swelled completely. Droplets of water on the surface of the polymer layer are carefully wiped off with filter paper. Another sample of each laminate structure is not wetted. A viscous alkali hydroxide solution thickened with hydroxyethyl cellulose is applied to both samples of each laminate structure. The time elapsed between the application of alkali and the response (colour change) of the indicator is shown in the following table for hydrated (wetted) and non-hydrated (dry) polymer layers. The table 2 in its last column shows the quotient $q$ for each of the polymer layers compared. The quotient $q$ is defined as $$q = \frac{\text{barrier time of non-hydrated polymer}}{\text{barrier time of hydrated polymer}}$$

In determining the quotient $q$ it was assumed that the barrier time is equal to the time of indicator response. Useful polymers for the retarding layer according to the present invention are those having a quotient $q$ of at least 10. The Table 2 clearly shows that the prior art retarding layers have q values which are far less than 10. That means the polymers according to the present invention in their nonhydrated state have barrier times which are at least 10 times the barrier times in the hydrated state.

Table 2

| retarding layer | | time of indicator response [seconds] | | quotient q determined as described herein before |
|---|---|---|---|---|
| polymer | thickness [μ] | dry | wetted | |
| DMOE/MOEOE | 8 | 90–105 | 5 | >18 |
| (10 mol %) | 16 | 210–225 | 5–10 | >21 |
| Latex | 8 | 120–180 | 120–180 | ~1 |
| Latex + PAA (40:1) | 18 | 120–180 | 120–180 | ~1 |
| PVA | 50 | 60–120 | 20–50 | ~3 |
| | 22 | 15–35 | 5–15 | ~3 |

Latex = Butac/DA/MAS/ST [60/30/6/4]
Copolymer of 60 parts butyl acrylate, 30 parts diaceton acrylamide, 6 parts methacrylic acid and 1 part styrene according to DT-OS 2 319 723
PAA = Polyacrylamide
PVA = Polyvinylalcohol

We claim:

1. A light-sensitive product for dye diffusion transfer comprising a light-sensitive film unit including at least one supported light-sensitive silver halide emulsion layer and a non-diffusing dye-giving compound associated with the silver halide emulsion layer an image-receiving layer in contact with the film unit to form with the unit a laminate a neutralisation system arranged on at least one side of the laminate, said system comprising a neutralisation layer with a polymer which contains free acid groups, said system being effective in aqueous alkaline processes of said product and a retarding layer containing a polymerisation product of at least 80 mol % of dimethoxyethylene and 0 to 20 mol % of one or more comonomers selected from compounds with a polymerisable double bond other than dimethoxyethylene said retarding layer being positioned between the laminate and the neutralisation layer.

* * * * *